US010435842B2

(12) United States Patent
Heiskanen et al.

(10) Patent No.: US 10,435,842 B2
(45) Date of Patent: Oct. 8, 2019

(54) SURFACE SIZING OF DENSE FILMS

(71) Applicant: Stora Enso OYJ, Helsinki (FI)

(72) Inventors: Isto Heiskanen, Imatra (FI); Kaj Backfolk, Lappeenranta (FI); Esa Saukkonen, Lappeenranta (FI)

(73) Assignee: Stora Enso OYJ, Helsinki, FL (US)

( * ) Notice: Subject to any disclaimer, the term of this patent is extended or adjusted under 35 U.S.C. 154(b) by 4 days.

(21) Appl. No.: 15/758,963

(22) PCT Filed: Sep. 16, 2016

(86) PCT No.: PCT/IB2016/055527
§ 371 (c)(1),
(2) Date: Mar. 9, 2018

(87) PCT Pub. No.: WO2017/046751
PCT Pub. Date: Mar. 23, 2017

(65) Prior Publication Data

US 2018/0245289 A1 Aug. 30, 2018

(30) Foreign Application Priority Data

Sep. 17, 2015 (SE) ..... 1551193-4

(51) Int. Cl.

| | |
|---|---|
| ***D21H 11/18*** | (2006.01) |
| ***D21H 21/16*** | (2006.01) |
| ***D21H 19/10*** | (2006.01) |
| ***D21H 19/36*** | (2006.01) |
| ***D21H 17/26*** | (2006.01) |
| ***D21H 17/57*** | (2006.01) |

(52) U.S. Cl.
CPC ..... *D21H 21/16* (2013.01); *D21H 11/18* (2013.01); *D21H 17/26* (2013.01); *D21H 17/57* (2013.01); *D21H 19/10* (2013.01); *D21H 19/36* (2013.01)

(58) Field of Classification Search
USPC ..... 162/164.6
See application file for complete search history.

(56) References Cited

U.S. PATENT DOCUMENTS

| | | | | |
|---|---|---|---|---|
| 2010/0024998 | A1* | 2/2010 | Wildlock | D21H 11/18 162/124 |
| 2015/0096700 | A1* | 4/2015 | Heiskanen | D21H 11/18 162/174 |

FOREIGN PATENT DOCUMENTS

| | | | |
|---|---|---|---|
| WO | 2008076056 | A1 | 6/2008 |
| WO | 2013160564 | A1 | 10/2013 |

OTHER PUBLICATIONS

International Search Report for PCT/IB2016/055527, dated Nov. 15, 2016.

* cited by examiner

*Primary Examiner* — Mark Halpern
(74) *Attorney, Agent, or Firm* — Greer, Burns & Crain, Ltd.

(57) ABSTRACT

A method for manufacturing a film, wherein said film has a basis weight of less than 50 g/m$^2$ and wherein the density of the film is higher than 750 kg/m$^2$ comprising the steps of: providing a suspension comprising microfibrillated cellulose (MFC); forming a web of said suspension on a porous wire, microfibrillated cellulose (MFC); surface sizing said web, wherein the web, at the beginning of the surface sizing step, has a moisture content in the range of from 10 to 50 wt-%; drying said surface sized web to a final moisture content of between 0.1-20 wt-% to form said film.

18 Claims, No Drawings

SURFACE SIZING OF DENSE FILMS

This application is a U.S. National Stage under 35 U.S.C. § 371 of International Application No. PCT/IB2016/055527, filed Sep. 16, 2016, which claims priority to Swedish patent application no. 1551193-4, filed Sep. 17, 2015.

TECHNICAL FIELD

The present document relates to a method for manufacturing dense films comprising microfibrillated cellulose (MFC).

More particularly, the present disclosure relates to surface sizing of dense films or webs.

BACKGROUND

Porous paper or paperboard is usually surface sized, or blade coated, in order to close the surface and hence to enhance the surface strength, optical properties or improve e.g. the printability.

However, impregnation or surface sizing of dense webs such as thin films made of cellulosic nanofibers or microfibrillated cellulose, with basis weight of around 10-30 g/m$^2$, is almost impossible since the surface is closed and not capable of absorbing surface sizing chemicals. In fact, a dense film with grammage of approximately 30 g/m$^2$, may have relatively good barrier properties measured as the oxygen transmission rate (OTR) particularly at 50% RH or below (see e.g. Aulin et al., Oxygen and oil barrier properties of microfibrillated cellulose films and coatings, Cellulose (2010) 17:559-574, Lavoine et al., Microfibrillated cellulose—Its barrier properties and applications in cellulosic materials: A review, Carbohydrate polymers 90 (2012) 735-764, Kumar et al., Comparison of nano- and microfibrillated cellulose films, Cellulose (2014) 21:3443-3456).

However, the surface treatment or impregnation of such a film at high speeds, where the contact times between coating or impregnation and drying are short, is very difficult. Without being bound to any theory, an extended impregnation nip and longer contact times will probable facilitate the film swelling, diffusion and penetration of both water and the applied chemicals. On the other hand, a prolonged impregnation step might also weaken the inter-fibrillar and cellulose interactions which lead to a weakened web, which then might break. The use of wetting chemicals, or chemicals that enhance the permeability might also be an option but in many applications there is a need to limit the amount of functional chemicals.

Another challenge of coating a nonporous web is to ensure that there are enough adhesion forces formed between the base substrate and the applied coating. In this respect, both mechanical interlocking and chemical or physical interactions are important for avoiding release of the applied coating.

Thus, surface sizing, film press sizing or other types of impact coating processes are not efficient on a very dense substrate and oftentimes lead to a structured substrate, i.e. a clear difference between top, middle and back layer.

By using e.g. rotogravure or reverse gravure or flexography, it is possible to apply thin or low amounts, of coating to the web. However, these methods usually put limitations on coating weights and machine widths. When the roll length exceeds a certain length, problems with the web profile (coat weight variations in cross-machine direction) may occur.

There is thus a need for a method of surface sizing dense films or webs, without causing any web breaks. Moreover, the method should be applicable for a high speed processes and wider paper machines.

SUMMARY

It is an object of the present disclosure, to provide an improved method for surface sizing of dense webs, which eliminates or alleviates at least some of the disadvantages of the prior art methods.

The invention is defined by the appended independent claims. Embodiments are set forth in the appended dependent claims and in the following description.

According to a first aspect, there is provided a method for manufacturing a film in a paper making machine, wherein said film has a basis weight of less than 50 g/m$^2$ and wherein the density of the film is higher than 750 kg/m$^3$ comprising the steps of:

providing a suspension comprising microfibrillated cellulose (MFC) in an amount of at least 30 weight %, preferably at least 50 weight %, based on the total weight of solids of the suspension;

forming a web of said suspension on a porous wire, surface sizing said web, wherein the web, at the beginning of the surface sizing step, has a moisture content in the range of from 10 to 50 wt-%;

drying said surface sized web to a final moisture content of between 0.1-20 wt-% to form said film.

The film formed in the process is a very dense and thin, i.e. low grammage, film, conventionally regarded as having a low pick-up of surface sizing chemicals. By the method it is thus possible to form a dense film from a wet web comprising the MFC suspension and with an applied coating, on one or two sides, that is impregnated in the base film more efficiently, i.e. penetrates into or in between the fibers of the web, thus avoiding the problems mentioned above. The web is formed from a suspension, or furnish, comprising microfibrillated cellulose (MFC) in an amount of at least 30 weight %, or at least 50 weight %, or at least 70 weight % or above 80 weight %, based on the weight of solids of the suspension. The microfibrillated cellulose content of the suspension may be in the range of 70 to 95 weight %, in the range of 70 to 90 weight %, or in the range of 70 to 90 weight %.

The improved penetration or impregnation of surface sizing chemicals may also provide for a more homogenous structure of the film and less tendency to curl, i.e. a reduced occurrence of drying shrinkage of the film.

Further, because the film is so thin, the web is more sensitive to web breaks especially if there are holes in the web. It has been shown that when surface sizing a web comprising microfibrillated cellulose (MFC), while the film is still wet, i.e. has a relatively high moisture content, the absorption and fixation of the sizing chemicals in the film is enhanced. The wet web has a higher porosity (compared to a dry web) and fibers with less hornificated structure, which enables easier absorption of the chemicals in the film. In a wet web, consolidation or strong interfibrillar interaction has not yet taken place, i.e. in the wet web the MFC fibers are not allowed to hornificate during drying. The web may thus have higher accessibility to the surface sizing chemicals, which enables the manufacturing of different types of thin impregnated films.

This enables chemicals to penetrate more efficiently and to interact with the cellulose more efficiently at higher degree of accessibility, for example to the cellulose. The method enables production of a film with high quality and provides a novel concept to introduce new functionalities to the film more efficiently both with regards to surface functionality and functionality that is incorporated into the structure. Which property or quality that is enhanced by the method depends on the requirements of the targeted end product. This means that if a dense film with high barrier properties is the target, the absorption and fixation of chemicals enhancing such properties may be enhanced through the method. The characteristics of the end product are thus dependant on type of surface sizing chemicals that are added, and the inventive method provides an enhanced effect of those chemicals.

Surface sizing on wet web may also enable more anionic (MFC)-cationic (surface size) interactions.

According to one embodiment of the first aspect, the film is made in a paper making machine and the substrate on which the web is formed is a porous wire. Alternatively, the film can be made by casting technologies whereby the substrate onto which the suspension is applied is a non-porous substrate such as a polymer substrate or metal belt. The film can also be made directly on a paper- or paperboard substrate.

According to one embodiment, in the step of surface sizing said web, the moisture content may be in the range of from 25 to 50 wt-%, or in the range of from 30 to 50 wt-%, or in the range of from 40-50 wt-%.

This means that the web, at the onset or beginning of the surface sizing step may still be substantially wet or moist.

According to one embodiment the moisture content of the film after drying may be in the range of from 1 to 8 wt-%, or in the range of from 3 to 6 wt-%.

The density of the film may be higher than 950 kg/m$^3$, or higher than 1050 kg/m$^3$.

According to one embodiment the microfibrillated cellulose (MFC) may be microfibrillated cellulose having a Schopper Riegler value (SR°) of more than 90 SR°, or more than 93 SR°, or more than 95 SR°. The microfibrillated cellulose may provide the web with high wet web strength, which further may enable or enhance the addition of the sizing chemicals.

According to one embodiment of the first aspect the surface sizing step may be performed in a size press, or a so called film press.

Previously it has been assumed that thin, i.e. low grammage, dense films of cellulosic nano- or microfibers need to be dried before surface sized in a size press, since otherwise the film is too weak and will break. However, contrary to previous assumptions, the inventors of this invention have surprisingly found that it is possible to surface size a wet thin film in a size press if the film comprises a high amount of microfibrillated cellulose (MFC), such as microfibrillated cellulose.

According to one embodiment of the first aspect, surface sizing chemicals are added in the surface sizing step, and the surface sizing chemical may be any one of water soluble polymers, such as sodium carboxymethyl cellulose (NaCMC), hydroxyethyl cellulose, ethylhydroxy ethyl cellulose, methyl cellulose, cellulose nanocrystals (CNC), starch, polyvinylalchol (PVA), partially hydrolysed polyvinyl alcohol, poly (diallyldimethylammonium chloride (PDADMAC), polyvinyl amine, polyethylene imine, polyvinyl acetate, styrene/butadiene latex, styrene/acrylate latex, protein, casein, modified starch polymers or particles, including combinations or modifications of the aforementioned polymers, and pigments, such as precipitated calcium carbonate (PCC), ground calcium carbonate (GCC), kaolin, talc, gypsum, bentonite, silica, and hemicellulose, and lignin, and functional additives such as optical brighteners, cross-linkers, softening agents, penetration enhancers, lubricants, dyes, hydrophobic/oleophobic chemicals, bioactive chemicals, or mixtures thereof.

The surface sizing chemical or mixture of chemicals used depends on the desired characteristics of the end product film. The inventive method, i.e. surface sizing a wet and dense web enables the use and application of various surface sizing chemicals.

According to an embodiment of the first aspect the method may further comprise the step of coating the web or film.

The step of coating the web may be applied before applying a mechanical impact on the web, i.e. before a press, or in other phases of the manufacturing process, such as before yankee cylinder, before calander nip, before dry section, before plastic coating etc.

According to one embodiment that the step of surface sizing may be performed with foam. This means that a foam is applied to the wet web, which foam comprises surface sizing chemicals.

The paper making machine may have a width of more than 2 m, or a width of more than 3.3 m.

When forming a film in a wide machine, it is usually difficult to get a uniform profile, when the roll length exceeds a certain length. This approach solves that particular problem. Through the inventive method it is thus possible to produce a dense surface sized film, comprising for instance MFC, in a wide papermaking machine.

According to a second aspect there is provided a film comprising a microfibrillated cellulose (MFC), obtainable by the method according to the first aspect, wherein the film has a basis weight of less than 50 g/m$^2$ and a density of more than 750 kg/m$^3$.

According to one embodiment of the second aspect the basis weight of the film may be less than 45 g/m$^2$, or less than 35 g/m$^2$, or less than 25 g/m$^2$, and wherein the density of the film is higher than 950 kg/m$^3$, or higher than 1050 kg/m$^3$. The film formed by the method of the invention exhibit an Oxygen Transmission Rate (OTR) value of below 100 ml/m$^2$/per 24 h at 50% RH, measured in accordance with the standard ASTM D3985-05, or less than 50 ml/m$^2$/day, or less than 10 ml/m$^2$/day or less than 1 ml/m$^2$/day.

DESCRIPTION OF EMBODIMENTS

According to one embodiment of the present invention a method for manufacturing or surface sizing a dense web or film is provided.

According to one embodiment the web, or the base web may be a wet laid web. The web, i.e. the base web, may be formed on a porous wire of a paper making machine.

According to one embodiment the film may have a basis weight in the range of from 5 to 50 g/m$^2$. According to another embodiment the basis weight may be in the range of from 10 to 40 g/m$^2$. According to yet an alternative the basis weight of the film may be in the range of from 10 to 30 g/m$^2$. This means that the film or web is a low grammage type of film or web.

According to one embodiment the density of the film or web may be in the range of from 750 kg/m$^3$ to 1750 kg/m$^3$. According to one embodiment the density is higher than 750 kg/m$^3$, according to an alternative the density is higher than 950 kg/m$^3$, and according to yet an alternative embodiment the density is higher than 1050 kg/m$^3$. The film may thus be a so called dense film.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., Cellulose fibres, nanofibrils and microfibrils: The morphological sequence of MFC components from a plant physiology and fibre technology point of view, Nanoscale research letters 2011, 6:417), while it is common that the aggregated form of the elementary fibrils, also defined as microfibril (Fengel, D., Ultrastructural behavior of cell wall polysaccharides, Tappi J., March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water.

The cellulose fiber is preferably fibrillated to such an extent that the final specific surface area of the formed MFC is from about 1 to about 300 m$^2$/g, such as from 1 to 200 m$^2$/g or more preferably 50-200 m$^2$/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofbril (CMF) defining a cellolose nanofbire material containing multiple elementary fibrils with both crystalline and amorphous regions, having a high aspect ratio with width of 5-30 nm and aspect ratio usually greater than 50.

According to one embodiment the MFC may have a Schopper Riegler value (SR°) of more than 90. According to another embodiment the MFC may have a Schopper Riegler value (SR°) of more than 93. According to yet another embodiment the MFC may have a Schopper Riegler value (SR°) of more than 95. The Schopper-Riegler value can be obtained through the standard method defined in EN ISO 5267-1. This high SR value is determined for a repulped wet web, with or without additional chemicals, thus the fibers have not consolidated into a film or started e.g. hornification. The dry solid content of this kind of web, before disintegrated and measuring SR, is less than 50% (w/w). To determine the Schopper Riegler value it is preferable to take a sample just after the wire section where the wet web consistency is relatively low. The skilled person understands that paper making chemicals, such as retention agents or dewatering agents, have an impact on the SR value.

The SR value specified herein, is to be understood as an indication but not a limitation, to reflect the characteristics of the MFC material itself. However, the sampling point of MFC might also influence the measured SR value. For example, the furnish could be either a fractionated or unfractionated suspension and these might have different SR values. Therefore, the specified SR values given herein, are thus either a mixture of coarse and fine fractions, or a single fraction comprising an MFC grade providing the desired SR value.

Due to the low grammage in combination with the thickness or density of the web or film, web breaks may easily occur if there are holes present in the web. The thin or dense films or coatings are usually associated with low pick-up amounts during surface sizing because the ability of the web to accept liquids and coating ingredients at short contact times or high speeds is often dependent on the surface porosity or permeability of the web. Normally when coating e.g. starch on a plastic film, which is comparable to the dense film as described in this disclosure, the applied starch will often dry, but is easy to remove after being dryed. Similar problem can also occur on when coating a dense web comprising microfibrillated cellulose.

According to the inventive method, the dense web, i.e. the base web, or film is surface sized when the web or film is still substantially wet. In a first step, a suspension comprising the microfibrillated cellulose (MFC) is applied on a substrate, such as a porous wire or membrane, dewatered and optionally partly dried to form a wet web.

This may be done in a conventional paper making machine, i.e. in any kind of paper making machine known to a person skilled in the art used for making paper, paperboard, tissue, or any similar products. According to one embodiment the width of the paper making machine is 2 m or more. According to another embodiment the width of the paper making machine is 3.5 m or more. This means that the paper making machine is relatively wide. Alternatively the MFC wet web could be prepared by casting the above described MFC suspension, e.g. at consistency of 5 to 25 wt-%, onto a non-porous substrate (such as a polymer substrate or metal belt). The web could further be made by applying the MFC suspension directly on the surface of a paper or paperboard.

According to the inventive method said formed wet web is then surface sized, or subjected to a surface sizing process, before drying the web to form a film.

According to one alternative the surface sizing chemicals are added in a conventional manner to the dense base web. According to another embodiment the surface sizing step is performed by adding a foam to the base web.

At the onset, or at the beginning of the surface sizing process the web may, according to one embodiment have a moisture content in the range of from 25 to 50 wt-%. According to one embodiment the moisture content may be at least >10 wt-%. According to another embodiment the moisture content may be at least 15 wt-%. According to yet another embodiment the moisture content may be at least 20 wt-%. According to yet an alternative the moisture content is at least 30 wt-%. In one embodiment the moisture content is around 40 wt-%.

During surface sizing, different types of surface sizing chemicals may be added. In the inventive method all conventional types of surface sizing chemicals or additives may be applied to the wet web. The method allows for good pick up of the chemicals or additives, even if the web is quite dense and thin, and reduced the z-profile variations after coating.

The sizing chemicals may be any one of water soluble polymers, such as sodium carboxymethyl cellulose (NaCMC), hydroxyethyl cellulose, ethylhydroxy ethyl cellulose, methyl cellulose, cellulose nanocrystals (CNC), starch, polyvinylalchol (PVA), partially hydrolysed polyvinyl alcohol, poly (diallyldimethylammonium chloride (PDADMAC), polyvinyl amine, polyethylene imine, polyvinyl acetate, styrene/butadiene latex, styrene/acrylate latex, protein, casein, modified starch polymers or particles, including combinations or modifications of the aforementioned polymers, and pigments, such as precipitated calcium carbonate (PCC), ground calcium carbonate (GCC), kaolin, talc, gypsum, bentonite, silica, and hemicellulose, and lignin, and functional additives such as optical brighteners, cross-linkers, softening agents, penetration enhancers, lubricants, dyes, hydrophobic/oleophobic chemicals, bioactive chemicals, or mixtures thereof.

According to another embodiment other surface sizing chemicals or additives may be used, depending on the desired end product and its characteristics.

One example may be stretch increasing chemicals, e.g. urethane, for forming a film that could be used for replacing plastic bags etc.

Additives for producing more rigid products, e.g. plates and floor coverings, may be such as melamine, urea formaldehyde, lignin-phenol-formaldehyde formulations, etc.

Yet another example is additives that provide a softening effect for the microfibrillated cellulose, such as sorbitol, xylitol, glycerol, glyceride, polyethylene glycol, or similar chemicals. The softening effect of the MFC is advantageous because MFC films may be quite brittle. Further to this, it is possible to achieve a more flexible film but also in the sense of adjusting haptic properties of the film. These chemicals, for example sorbitol, are water soluble, and difficult to add in the wet end of a paper or paperboard machine. Many of the functional chemicals are also expensive and may cause foaming, which increases problems during the film formation. Typically, when these chemicals are used, the films must first be produced by completely dewatering and drying of the entire MFC suspension. In the present invention the wet MFC film is only dewatered to a certain moisture content, i.e. the web is still substantially wet or moist when the surface sizing process begins.

According to one alternative it is also possible to add microfibrillated or nanofibrillated cellulose in the surface sizing step. It is also possible to add cellulose nanocrystals (CNC), hemicellulose and lignin.

For the surface sizing or surface treatment process step, it is possible to use different types of coating or impregnation methods. According to one alternative a surface size press may be used.

By surface sizing is thus meant contact coating methods used in paper and paperboard industry. Those are e.g. film press, surface sizing (pound or flooded nip size press), gate roll, Gate roll Inverted coater, Twin HSM applicator, Liquid application system, blade/roll metering with the Bill blade, TwoStream, Blade/Blade metering with the mirrorBlade, VACPLY, or application and metering with a nozzle unit onto paper web (Chapt. 14, Coating and surface sizing technologies, Linnonmaa, J., and Trefz, M., in Pigment coating and surface sizing of paper, Papermaking Science and Technology, Book 11, $2^{nd}$ Ed., 2009). In addition, reverse gravure or gravure methods, sizing based on indirect metering onto roll using e.g. spray, spinning or foam deposition may also be included in this definition. Other variations and modifications or combinations of the coating methods, obvious for a person skilled in the art, are also included herein.

According to one embodiment the base film, i.e. base web may be impregnated or surface sized on one side. According to another embodiment the base web may be impregnated or surface sized on both sides. According to an alternative embodiment the impregnation can also be done in several steps if needed with interim drying.

According to one embodiment, the coated web may be calandered. The final density, film properties and moisture content may thus be adjusted in the calender. Known techniques such as hard-nip, soft-nip, soft-hard nip, cylinder or belt, in various forms and combinations can be used.

After the sizing step the web may be dried to a final moisture content using either radiation during methods such as infrared or near-infrared, air dryers, cylinder dryers, such as a Yankee dryer, or belt dryers. The drying is preferably a combination of the methods mentioned, preferably a non-contact method (radiation) before a contact drying method (cylinder drying).

According to one embodiment the surface sizing is performed in a roll application or a rod application, i.e. either roll or rod coating. According to one embodiment this may then be followed by drying of the web in a Yankee dryer or cylinder. This method of forming the film may provide for a smooth surface of the film, with little or no drying shrinkage.

According to one embodiment the final moisture content of the film is in the range of from 0.1 to 20 wt-%. According to another embodiment the final moisture content is in the range of from 1 to 15 wt-%. According to an alternative embodiment the final moisture content is in the range of from 3 to 10 wt-%. According to an alternative embodiment the final moisture content is in the range of from 3 to 6 wt-%. According to one embodiment the moisture content of the final film is around 6 wt-%.

According to one embodiment the web may be a never-dried wet web.

According to one embodiment it is further possible to include various non-impact coating methods to apply coating, before applying a mechanical impact, such as spray, foam, slot die, curtain, etc. It is also possible to apply the coating in various phases in the process such as before Yankee cylinder, before calander nip, before dry section, before plastic coating etc.

According to another embodiment the product may be single or double coated.

The drying step may be performed with any conventional means, e.g. through dewatering on the web by air, hot air, vacuum, or by using heating roll. The drying can further be performed with infrared heat (IR), near infrared heat (NIR) or air.

Possible applications and advantages with the film obtained through the above described method may be:

Increased transmittance through the wet web sizing it is possible to reduce light reflecting surfaces (i.e. make optical contacts) and to make films more transparent.

Increased flexibility by interfering fibril/fibril bonds inside of the material it is possible to change the flexibility of the films. The film may for instance be easier to convert, and there may be less cracking and tearing etc. of the film.

Increased strength by enhancing fibril/fibril bonds inside of the material it is possible to amend the strength of the films.

Increased wet strength by protecting fibril/fibril bonds with chemicals penetrating the film it is possible to increase the wet strength of the film.

EXAMPLES

Trial 1

In a first trial (trial 1) the base sheet had a basis weight of 25 g/m$^2$ and the production speed was 15 m/min.

This trial was performed in a size press with a pound or flooded nip type of dosing or feeding of surface size suspension, adding CMC as a surface sizing chemical. The trial was performed with two different solids content of the wet web or film, i.e. different moisture content. The pick-up describes how well the film has absorbed the surface sizing chemical.

When the solid content before size press was 74%, i.e. a wet web, the total pick-up or coat weight was about 2.2 g/m$^2$ which means 1.1 g/m$^2$ per side.

When the solid content of the wet web before size press was >95%, i.e. a conventionally dried web, the pick-up was 0.58 g/m$^2$, which means 0.29 g/m$^2$ per side.

This trial shows that by surface sizing the wet web the pick-up was greatly increased.

In view of the above detailed description of the present invention, other modifications and variations will become apparent to those skilled in the art. However, it should be apparent that such other modifications and variations may be effected without departing from the spirit and scope of the invention.

Trial 2

In a second trial (trial 2) the base sheet had a basis weight of 30 g/m$^2$ and the production speed was 30 m/min.

This trial was performed in a size press with a pound or flooded nip type of dosing or feeding of surface size suspension, adding cationic polysaccharide, fine MFC, and polyurethane-elastomer as a surface sizing chemical. The trial was performed with two different solids content of the wet web or film, i.e. different moisture content. The pick-up describes how well the film has absorbed the surface sizing chemical. Results for pick-up are summarized for wet-web (dmc approximately 55 w %) and dry web (dmc>95 w %) in Table 1.

TABLE 1

Trial 2 results

| | Web solids [w %] | Total pick-up [g/m2] | Pick-up per side [g/m2] |
|---|---|---|---|
| Cationic polysaccharide | 55% | 0.19 | 0.095 |
| | >95% | 0.08 | 0.040 |
| Fine MFC | 55% | 0.31 | 0.155 |
| | >95% | 0.15 | 0.075 |
| Polyurethane-elastomer | 55% | 3.20 | 1.600 |
| | >95% | 1.54 | 0.770 |

This trial 2 shows that by surface sizing the wet web the pick-up was significantly increased.

The invention claimed is:

1. A method for manufacturing a film, wherein said film has a basis weight of less than 50 g/m$^2$ and wherein the density of the film is higher than 750 kg/m$^3$ comprising the steps of:

providing a suspension comprising at least 30 weight % microfibrillated cellulose (MFC) based on the total weight of solids of the suspension;

forming a web of said suspension on a substrate;

surface sizing said web, wherein the web, at the beginning of the surface sizing step, has a moisture content in the range of from 10 to 50 wt-%; and drying said surface sized web to a final moisture content of between 0.120 wt-% to form said film.

2. The method as claimed in claim 1, wherein the film is made in a paper making machine and the substrate on which the web is formed is a porous wire.

3. The method as claimed in claim 2, wherein paper making machine has a width of more than 3.3 m.

4. The method as claimed in claim 1, wherein in the step of surface sizing said web, the moisture content is in the range of from 25 to 50 wt-%.

5. The method as claimed in claim 1, wherein the moisture content of the film after drying is in the range of from 1 to 8 wt-%.

6. The method as claimed in claim 1, wherein the density of the film is higher than 950 kg/m$^3$.

7. The method as claimed in claim 1, wherein the microfibrillated cellulose (MFC) has a Schopper Riegler value (SR°) of more than 90 SR°.

8. The method as claimed in claim 1, wherein the surface sizing step is performed in a size press, or a film press.

9. The method as claimed in claim 1, wherein the step of surface sizing is performed with foam.

10. The method as claimed in claim 1, wherein in the surface sizing step surface sizing chemicals are added selected from the group of carboxymethyl cellulose (NaCMC), hydroxyethyl cellulose, ethylhydroxy ethyl cellulose, methyl cellulose, cellulose nanocrystals (CNC), starch, polyvinylalchol (PVA), partially hydrolysed polyvinyl alcohol, poly (diallyldimethylammonium chloride (PDADMAC), polyvinyl amine, polyethylene imine, polyvinyl acetate, styrene/butadiene latex, styrene/acrylate latex, protein, casein, modified starch polymers or particles, including combinations or modifications of the aforementioned polymers, and pigments, such as precipitated calcium carbonate (PCC), ground calcium carbonate (GCC), kaolin, talc, gypsum, bentonite, silica, and hemicellulose, and lignin, and functional additives such as optical brighteners, cross-linkers, softening agents, penetration enhancers, lubricants, dyes, hydrophobic/oleophobic chemicals, bioactive chemicals, or mixtures thereof.

11. The method as claimed in claim 1, wherein the method further comprises the step of coating the web or film.

12. The method as claimed in claim 2, wherein paper making machine has a width of more than 2 m.

13. The method as claimed in claim 1, wherein in the step of surface sizing said web, the moisture content is in the range of from 30 to 50 wt-%.

14. The method as claimed in claim 1, wherein in the step of surface sizing said web, the moisture content is in the range of from 40-50 wt-%.

15. The method as claimed in claim 1, wherein the moisture content of the film after drying is in the range of from 3 to 6 wt-%.

16. The method as claimed in claim 1, wherein the density of the film is higher than 1050 $kg/m^3$.

17. The method as claimed in claim 1, wherein the microfibrillated cellulose (MFC) has a Schopper Riegler value (SR°) of more than 93 SR°.

18. The method as claimed in claim 1, wherein the microfibrillated cellulose (MFC) has a Schopper Riegler value (SR°) of more than 95 SR°.

* * * * *